US006315606B1

(12) United States Patent
Hwang

(10) Patent No.: US 6,315,606 B1
(45) Date of Patent: Nov. 13, 2001

(54) BLIND MATE CONNECTOR

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/556,896

(22) Filed: Apr. 20, 2000

(51) Int. Cl.[7] ..... H01R 13/74
(52) U.S. Cl. ..... 439/557; 439/378
(58) Field of Search ..... 439/567, 571, 439/572, 378, 680, 247, 248, 557

(56) References Cited

U.S. PATENT DOCUMENTS 4,988,308 * 1/1991 Toedtman ..... 439/248
5,312,264 * 5/1994 Thomas et al. ..... 439/247
5,391,091 * 2/1995 Nations ..... 439/378
5,810,614 * 9/1998 Ruch ..... 439/247

* cited by examiner

*Primary Examiner*—Gary F. Paumen
(74) *Attorney, Agent, or Firm*—Wei Te Chung

(57) ABSTRACT

A blind mate male connector has a dielectric housing having a rear surface and an opposite mating surface. A spacer plate integrally traverses an intermediate portion of the first housing. A pair of guiding posts extends from the spacer plate and beyond an imaginary plane of the mating surface of the dielectric housing for firstly engaging with a complementary connector when the male connector is initially engaged with a complementary connector.

1 Claim, 11 Drawing Sheets

BLIND MATE CONNECTOR

BACKGROUND OF THE INVENTION

1. Field of the Invention

The present invention relates to a blind mate connector in which a guiding means is formed on the blind mate connector to facilitate interconnection with a complementary connector.

2. The Prior Art

Blind mate connectors are used popularly for interconnection between two units of cables or between one unit of cable and a printed circuit board. Such connectors are disclosed in U.S. Pat. No. 5,342,221, where a male connector having a plurality of silos arranged in rows and extending from a front face thereof is engageable with a female connector having corresponding number of receptacles for mating with the silos. Since the silos of the male connector in rows have to be simultaneously inserted into the receptacles of the female connector, a registration procedure needs to be performed before engaging the male and female connectors thus causing inconvenience and time consuming. It is requisite to improve the structure of the blind mate connectors for solving the above problem.

SUMMARY OF THE INVENTION

The primary purpose of the present invention is to provide an improved blind mate connector which can be properly engaged with a complementary connector easily.

One aspect of the present invention is to provide a male connector having a dielectric housing which includes a rear surface and an opposite mating surface. A spacer plate integrally traverses an intermediate portion of the first housing. A pair of guiding posts extends from the spacer plate and beyond an imaginary plane of the mating surface of the dielectric housing for firstly engaging with a complementary connector when the male connector is initially engaged with a complementary connector.

Another aspect of the present invention is to provide a wire-to-board connection system comprising a male connector module and a female connector module connected to the male connector module, wherein the male connector module has a male connector fixed to a first board and the female connector module has a female connector fixed to a second board. The male connector comprises a first housing having a rear surface from which a plurality of electrical wires extend and a mating surface opposite to the rear surface, a spacer plate integrally traversing an intermediate portion of the first housing, and a pair of guiding posts extending from the spacer plate and beyond an imaginary plane of the mating surface of the first housing. The female connector comprises a second housing defining a reception cavity having two end portions for firstly receiving the two guiding posts of the male connector and a center portion for successively and immediately receiving a half portion of the first housing of the male connector when the male connector is engaged with the female connector.

Further another aspect of the present invention is to provide a wire-to-wire connection system comprising a male connector module adapted to engage with a female connector module, wherein the male connector module has a male connector fixed to a first board and the female connector module has a female connector fixed to a second board. The male connector comprises a first housing having a rear surface from which a plurality of first wires extend and a mating surface opposite to the rear surface, a spacer plate integrally traversing an intermediate portion of the first housing, and a pair of guiding posts extending from the spacer plate and beyond an imaginary plane of the mating surface of the first housing. The female connector comprises a second rear housing from which a plurality of second wires extend and a second front housing defining a reception cavity having two end portions for firstly receiving the two guiding posts of the male connector and a center portion for successively and immediately receiving a half portion of the first housing of the male connector when the male connector is engaged with the female connector.

DETAILED DESCRIPTION OF THE PREFERRED EMBODIMENT

Figure 1:
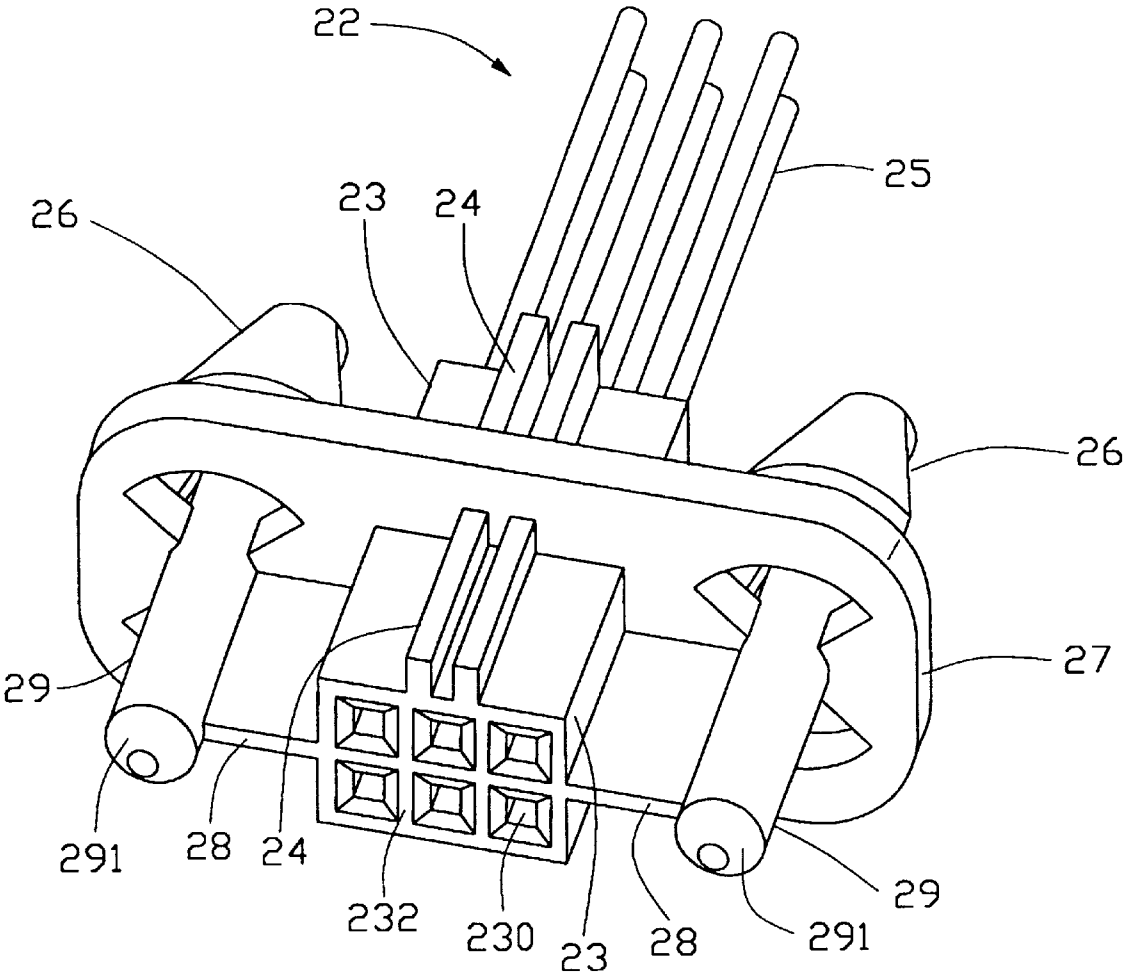
FIG. 1 is a perspective view of a male blind mate connector in accordance with the present invention.
Figure 2:
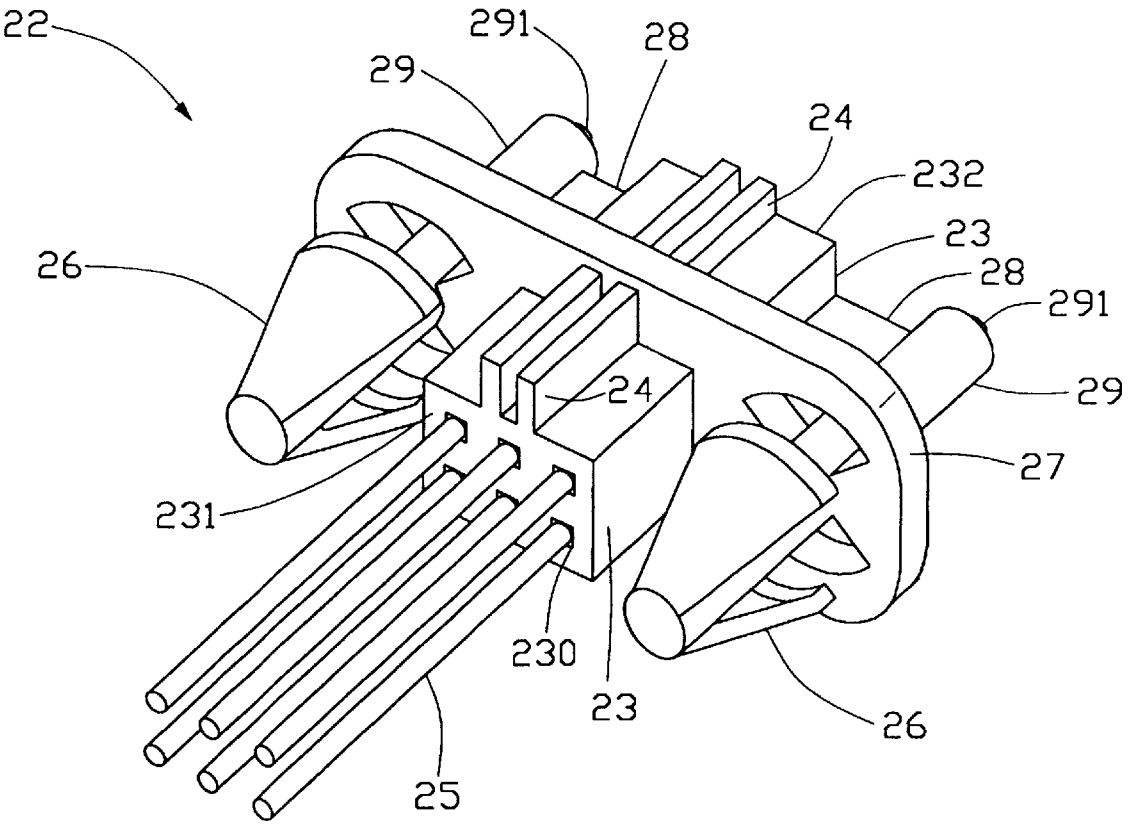
FIG. 2 is the same connector of FIG. 1 taken from a different angle.

Referring to FIGS. 1 and 2, a male blind mate connector 22 in accordance with the present invention comprises a dielectric first housing 23 (hereinafter referred as first housing) having a rear surface 231 and an opposite mating surface 232, two parallel ribs 24 formed at one surface of the first housing 23, and a spacer plate 27 integrally traversing and surrounding an intermediate portion of the first housing 23. A pair of conic board locks 26 extends from one side of the spacer plate 27 near two ends thereof, while a pair of guiding posts 29 extends from an opposite side of the spacer plate 27 and substantially registers with the pair of the conic board locks 26. Each guiding post 29 has a conic head 291 which extends beyond an imaginary surface of the mating surface 232 of the first housing 23 for guiding purpose which will be explained later. An intermediate plate 28 is connected between the guiding post 29 and the first housing 23 for reinforcing the guiding post 29. A plurality of passageways 230 are defined through the first housing 23 and each passageway 230 receives both a receptacle-type contact (not shown) and an electrical wire 25 which connects with the receptacle-type contact (not shown) at one end thereof.

Figure 3:
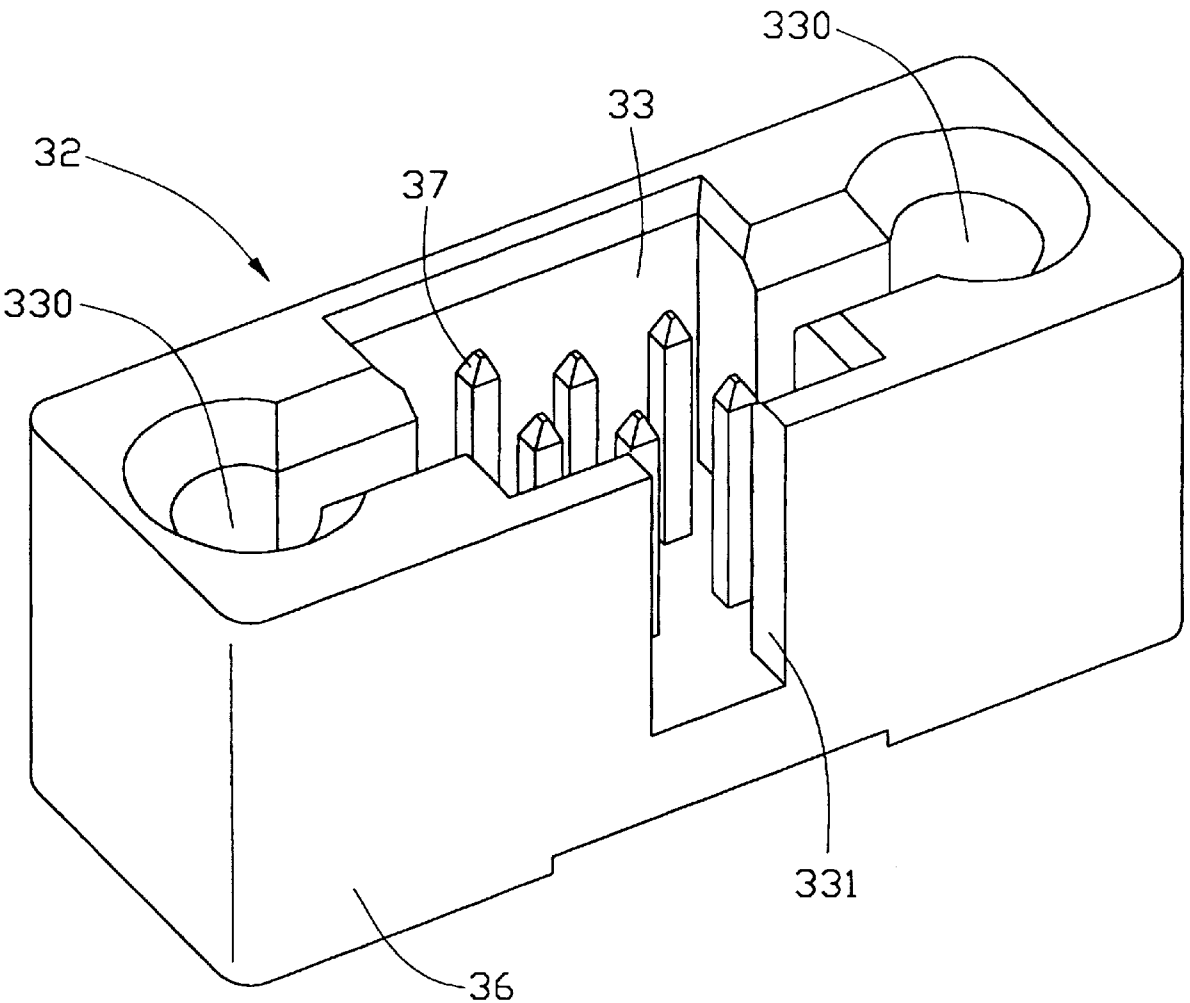
FIG. 3 is a perspective view of a female blind mate connector in accordance with the present invention.
Figure 4:
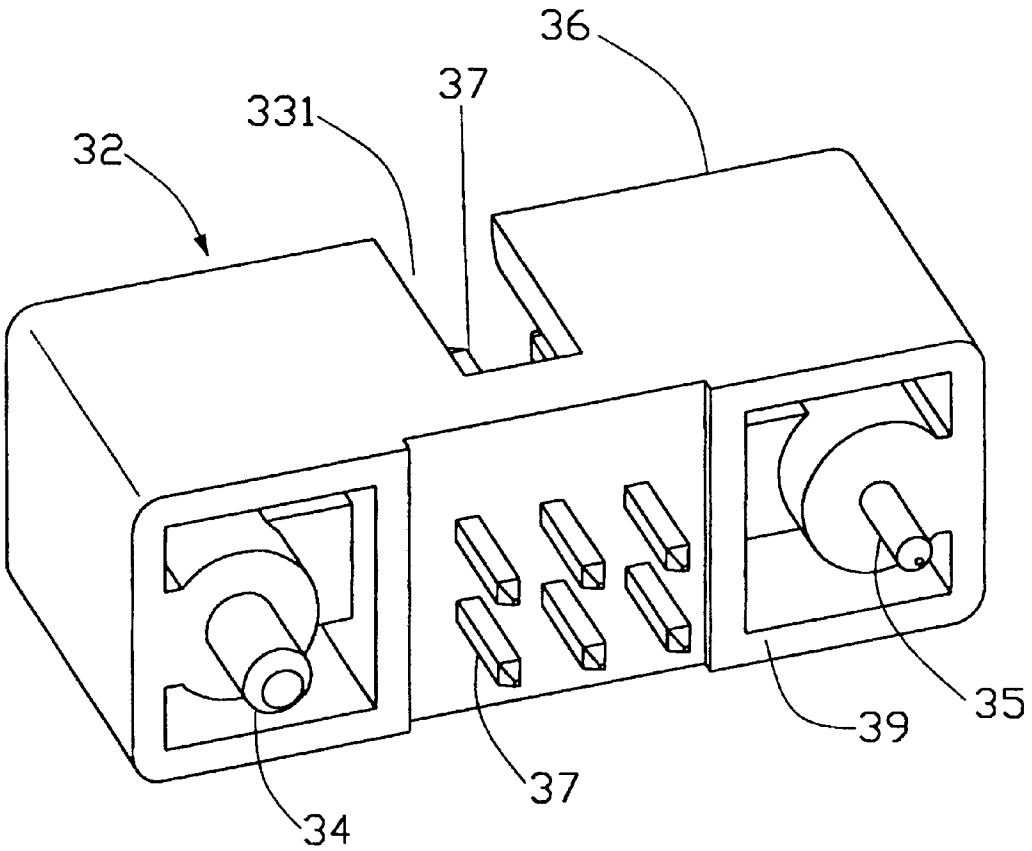
FIG. 4 is the same connector of FIG. 3 taken from a different angle.

Referring to FIGS. 3 and 4, a female blind mate connector 32 (hereinafter referred as female connector) comprises a dielectric second housing 36 (hereinafter referred as second housing) defining a reception cavity 33 therein which has a substantially cross shape in its cross section, a plurality of plug-type contacts 37 extending in the reception cavity 33 for interconnection with the receptacle-type contacts (not shown) of the male connector 22, and two holes 330 defined at two ends of the reception cavity 33 properly dimensioned for receiving the guiding posts 29 of the male connector 22. Specifically, each hole 330 has a diverged end section for facilitating insertion of the guiding post 29 of the male connector 22. A keyway 331 is defined at one surface of the second housing 36 for mating with the parallel ribs 24 of the male connector 22. A first positioning post 34 and a second positioning post 35 extend from a bottom surface 39 of the second housing 36 and the first positioning post 34 has a relatively larger diameter than that of the second positioning post 34.

Figure 5:
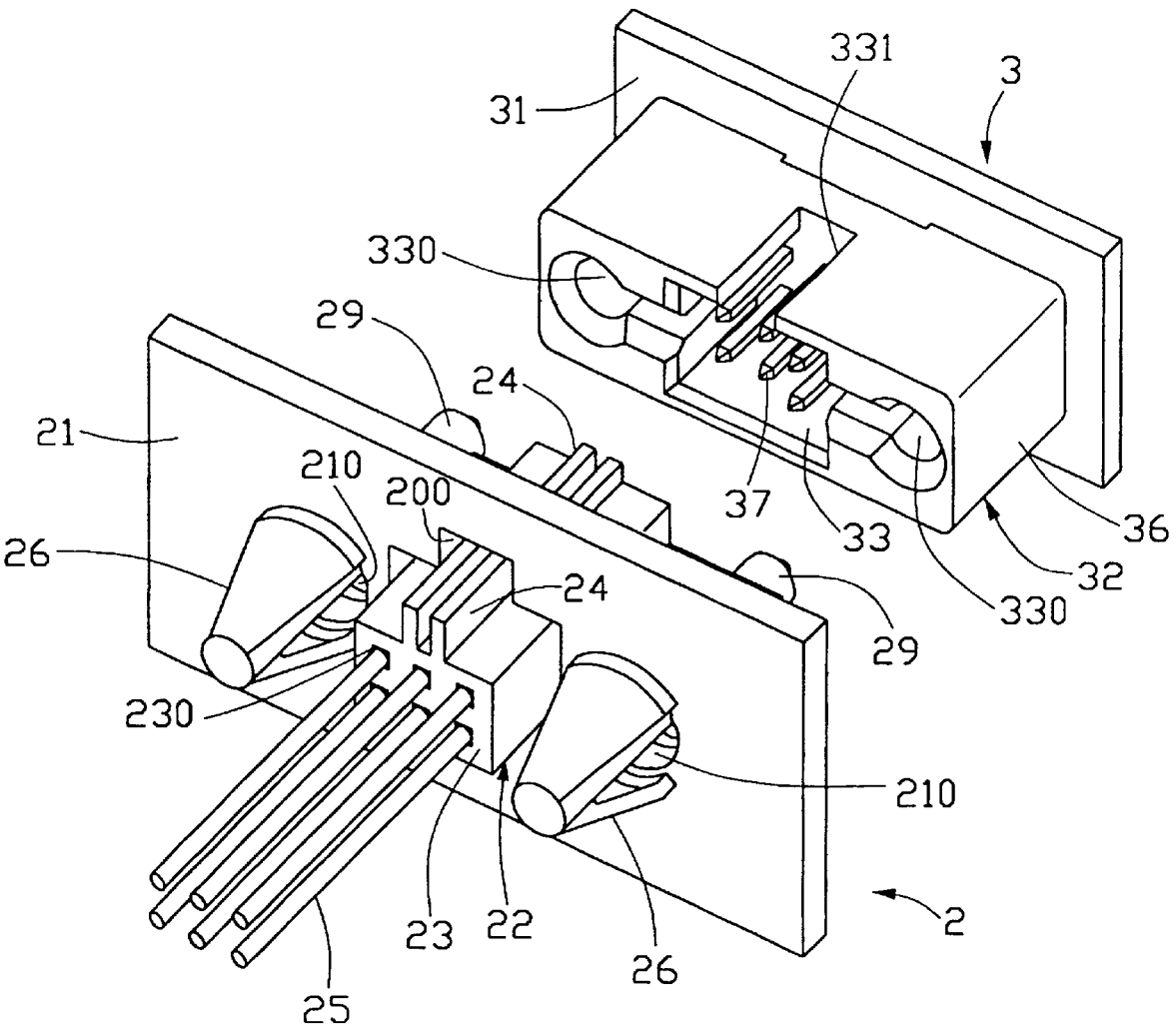
FIG. 5 illustrates that the male and female connectors of FIGS. 1 and 3 are respectively fixed to a board and to be engaged.
Figure 6:
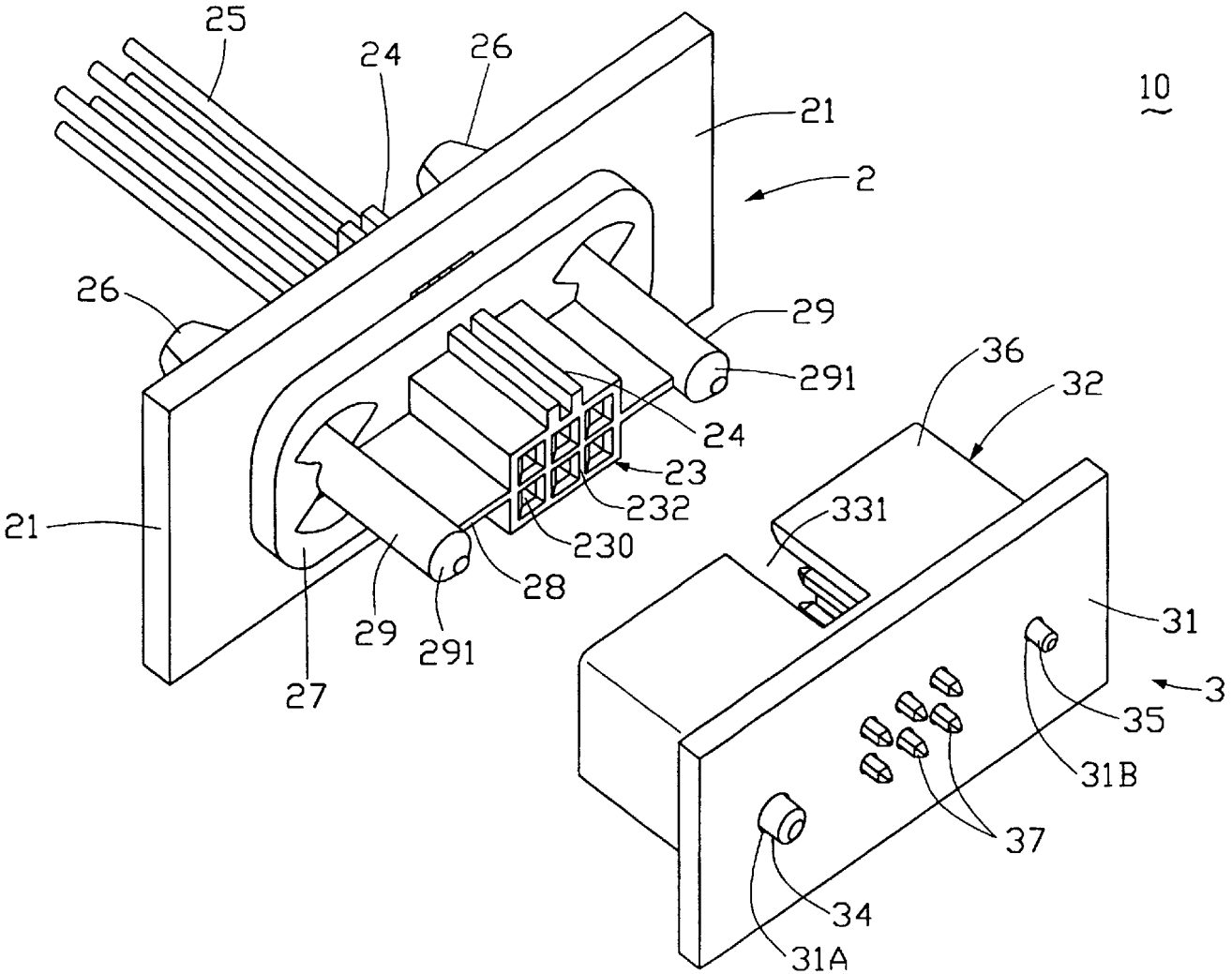
FIG. 6 is a similar view of FIG. 5 taken from different angle.

Referring to FIGS. 5 and 6, the male connector 22 and the female connector 32 are respectively fixed to a first board or panel 21 and a second board 31 to respectively constitute a male connector module 2 and a female connector module 3 before engaging with each other. The second board 31 may be a printed circuit board in this embodiment. Each conic board lock 26 is forcedly passed through a corresponding locking hole 210 defined in the first board 21 and abut against periphery solid portion around the locking hole 210 in one surface of the first board 21, meanwhile the spacer plate 27 abuts against an opposite surface of the first board 21. The first positioning post 34 and the second positioning post 35 of the female connector 32 are respectively retained in a relatively large hole 31A and a relatively small hole 31B defined in the second board 31 and the bottom surface 39 of the female connector 32 contacts with the second board 31.

Figure 7:
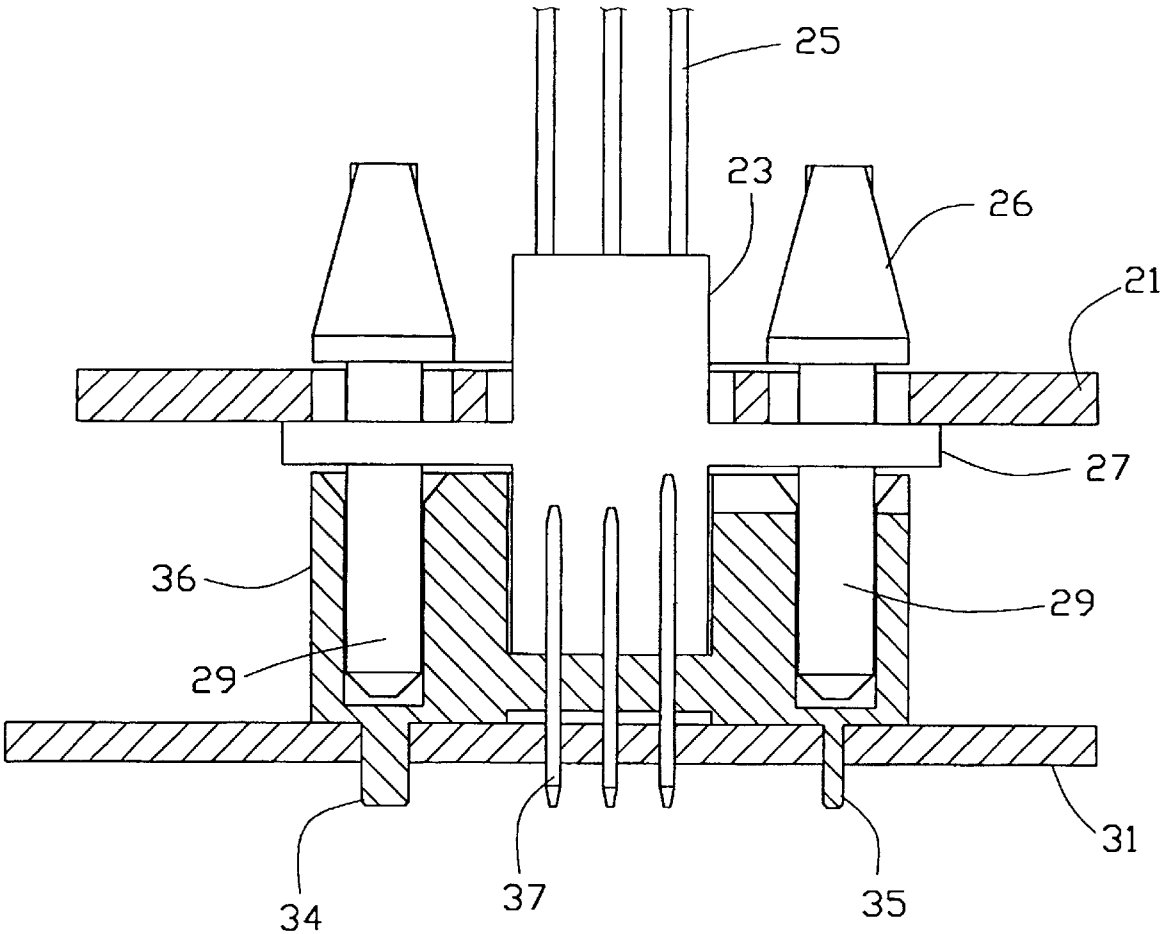
FIG. 7 is a schematic sectional assembled view of the connectors of FIG. 5.

During engagement of the male connector 22 and the female connector 32, the conic head 291 of each guiding post 29 is firstly inserted into the hole 330, then a front half portion of the first housing 23 and the intermediate plates 28 are inserted into and retained in the cross-shaped reception cavity 33 immediately, thus forming a so called wire-to-board connection as known in this field. The assembled schematic view may be referred to FIG. 7, wherein the first board 21 and the second board 31 are maintained in parallel with each other by the engaged connectors 22, 32. The plug-type contact 37 is engaged with the receptacle-type contact which is not shown for simplification. It should be noted that the engagement between the two connectors 22, 32 is quite easy due to the guiding function of the guiding posts 29.

Figure 8:
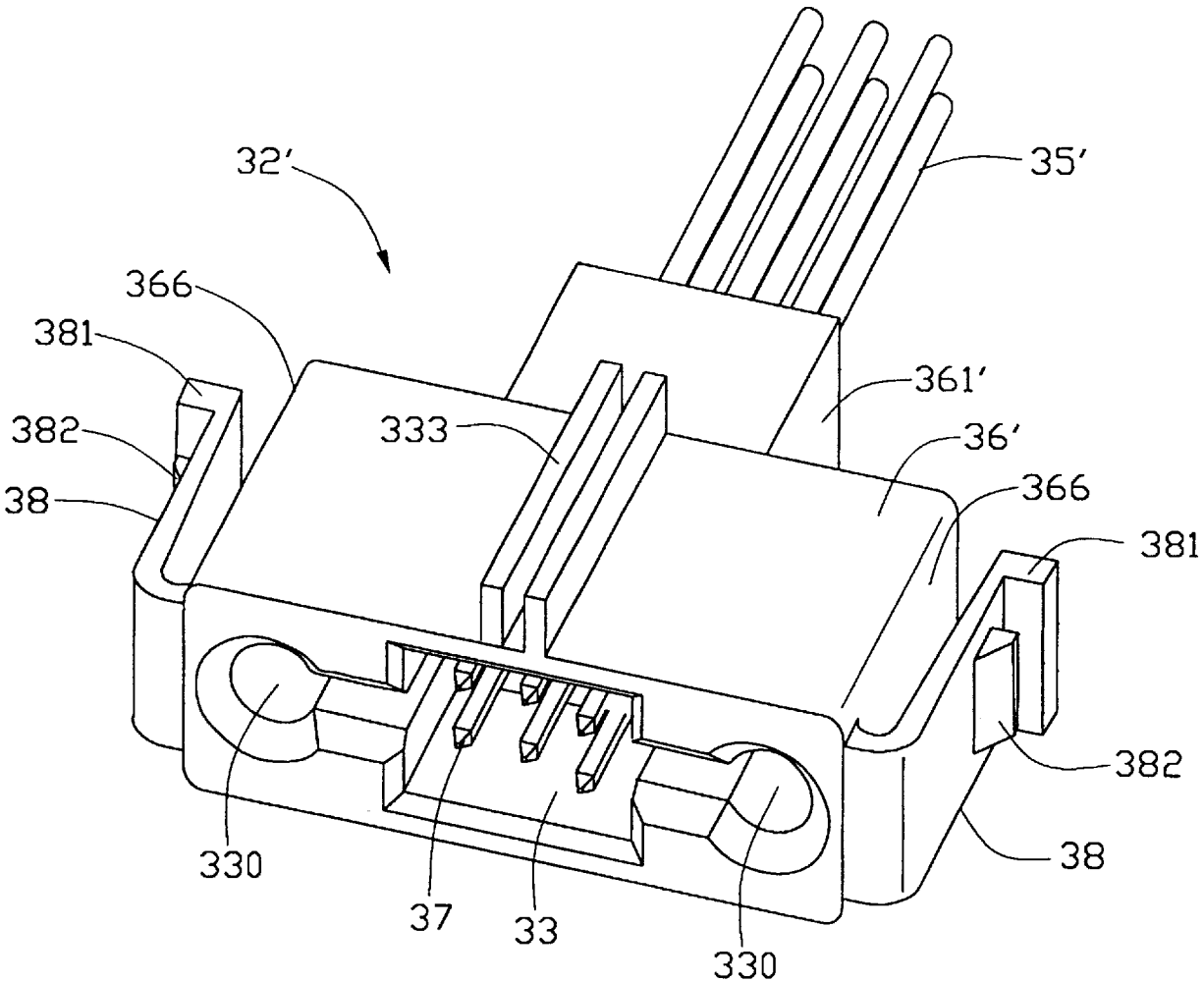
FIG. 8 is a second embodiment of the female connector.

Referring to FIGS. 3 and 8 for comparison, a second embodiment of the female connector 32' is particularly shown in FIG. 8, where like numerals of FIG. 8 represent the same parts or structures to those discussed in conjunction with FIG. 3. The female connector 36' comprises a dielectric front housing 36' which defines the reception cavity 33, the holes 330 same to those defined in the previous embodiment and also includes a plurality of plug-type contacts 37. Two parallel ribs 333 are formed on one surface of the housing 36' while the keyway 331 of FIG. 3 does not exist. A rear housing 361'0 is integrally formed with the front housing 36' and defines passageways (not shown) for retaining the plug-type contacts 37. A plurality of wires 35' are partially retained in the passageways (not shown) and electrically connected to the plug-type contacts 37. Two latches 38 cantilever from opposite side surfaces 366 of the front housing 36' and each latch 38 terminates as a stop plate 381. A tapered protrusion is formed near the stop plate 381.

Figure 9:
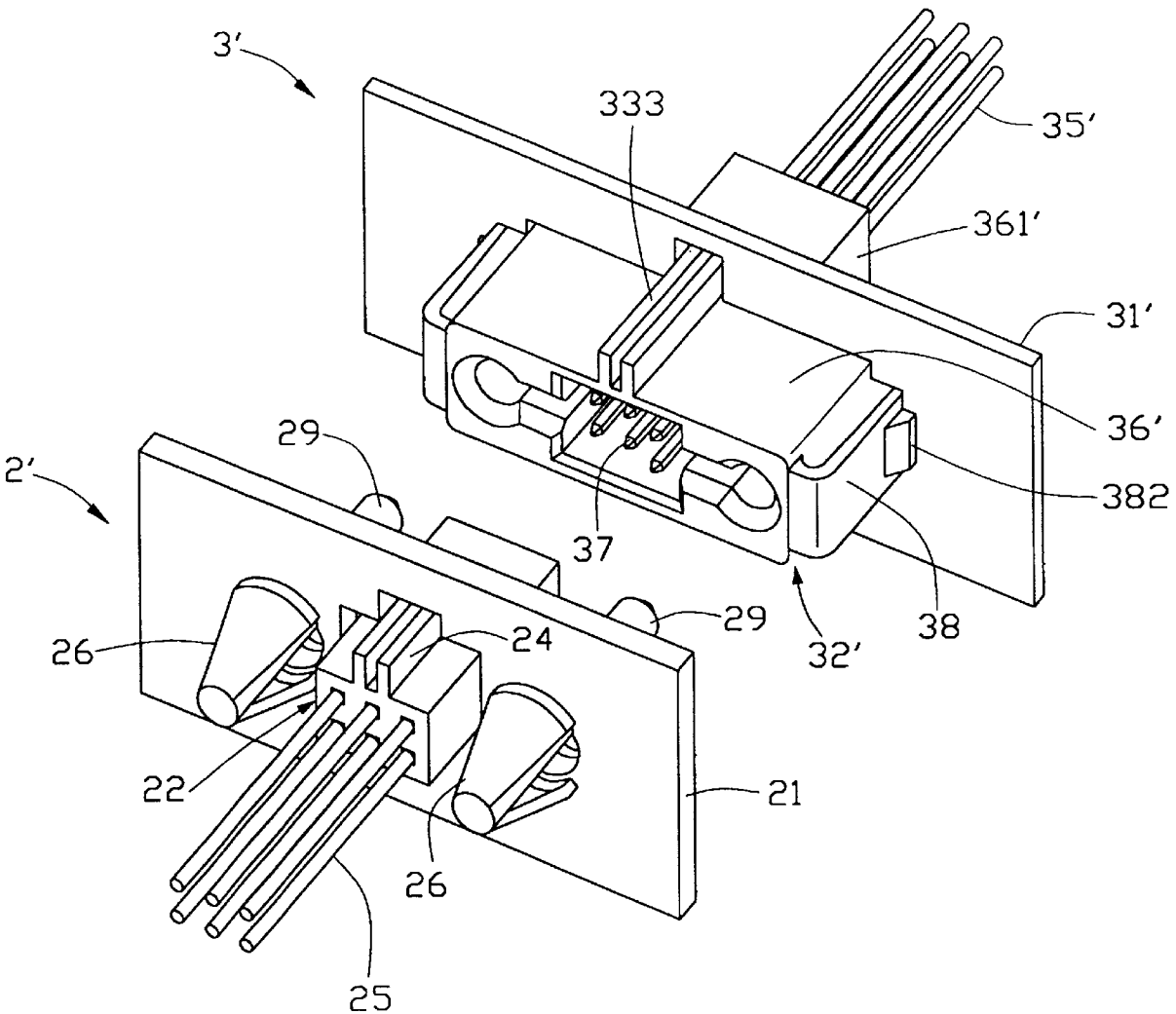
FIG. 9 illustrates that the female connector of FIG. 8 is fixed to a board and to be engaged with a male connector similar to that of FIG. 5.
Figure 10:
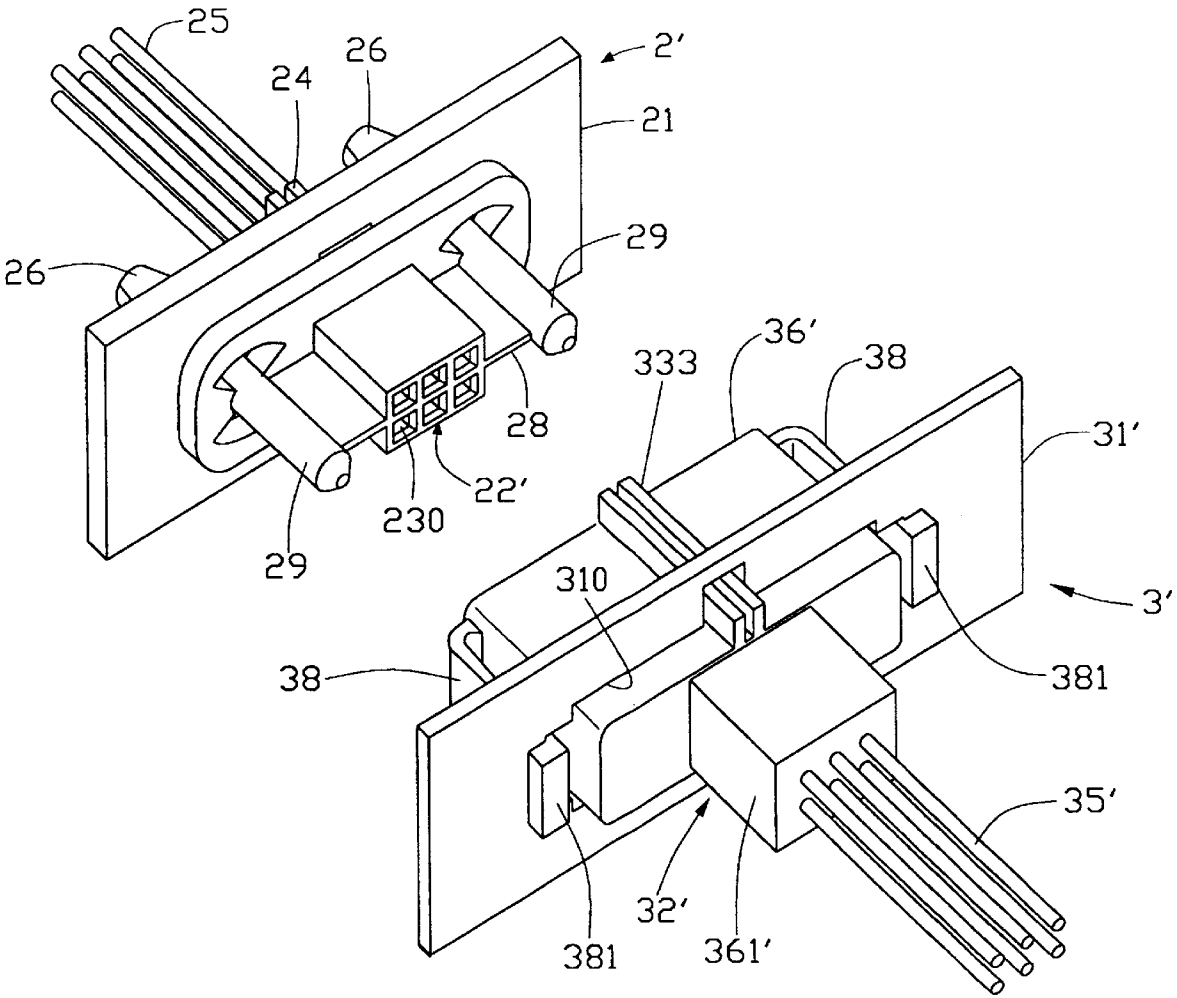
FIG. 10 is a similar view of FIG. 9 taken from a different angle.

Referring to FIGS. 9 and 10, for mating with the new embodiment of the female connector 32', a new male connector 22' is provided which is almost the same with the male connector 22 of the previous embodiment (see FIGS. 1 and 2), except that a front half portion of the parallel ribs 24 is removed. Similar to the previous embodiment, the male connector 22' and the female connector 32' are respectively fixed to the first board 21 and a third board or panel 31' to respectively constitute a male connector module 2' and a female connector module 3' before engaging with each other. The third board 31' is a metal plate in this embodiment. The latches 38 of the female connector 32' are forcibly engaged with periphery solid portion around a hole 310 which is defined through a center large portion of the third board 31', with the tapered protrusion 382 and the stop plate 381 sandwiching a solid edge portion by the hole 310.

Figure 11:
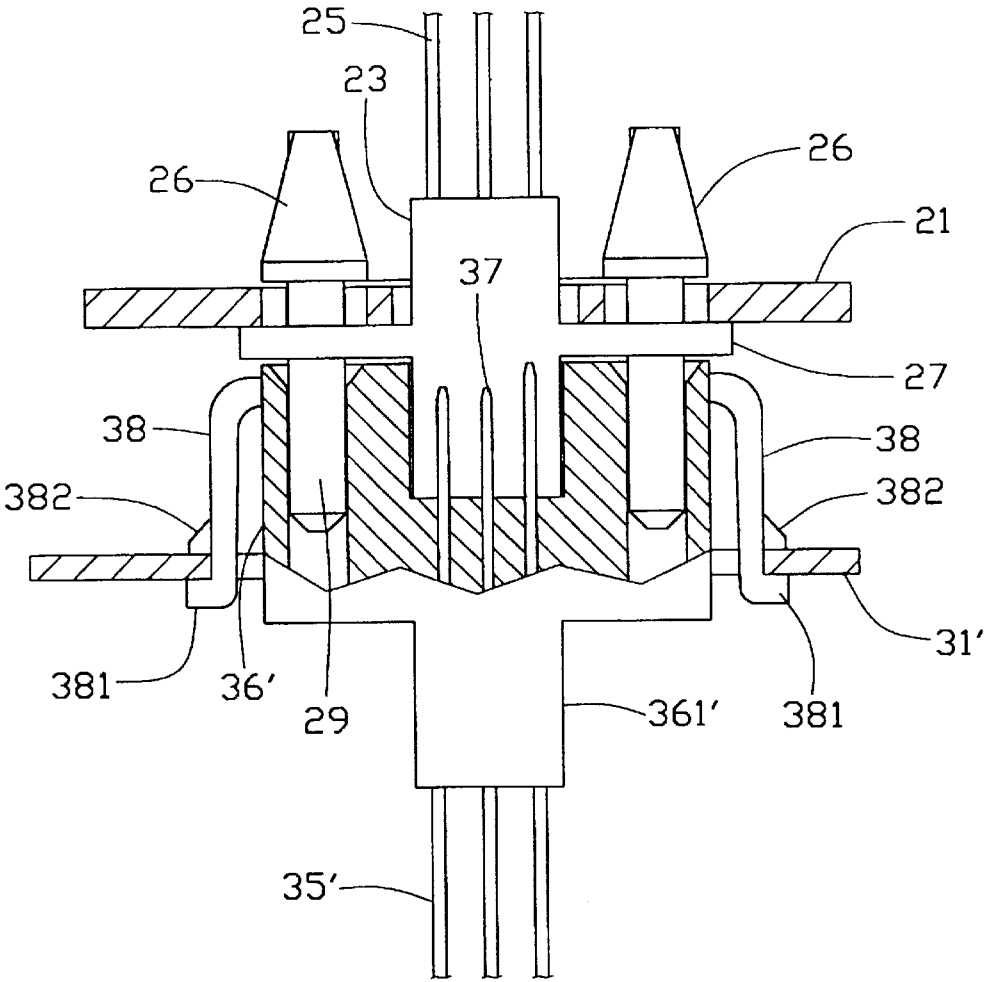
FIG. 11 is a schematic assembled sectional view of the connectors of FIG. 10.

During engagement of the male connector 22' and the female connector 32', the conic head 291 of each guiding post 29 is firstly inserted into the hole 330, then a front half portion of the first housing 23 and the intermediate plates 28 are inserted into and retained in the reception cavity 33 immediately, similar to the previous embodiment, thus forming a so called wire-to-wire connection as known in this field. The parallel ribs 333 function as polarization key preventing the user from mal-connection. An assembled schematic view of the connectors disclosed in FIGS. 9 and 10 may be referred to FIG. 11, wherein the first board 21 and the third board 31' are maintained in parallel with each other by the engaged connectors 22', 32'. The plug-type contact 37 is engaged with corresponding receptacle-type contact which is not shown for simplification.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A male connector comprising:

a dielectric housing having a rear surface and an opposite mating surface;

a spacer plate integrally traversing an intermediate portion of the first housing; and a pair of guiding posts extending from the spacer plate and beyond an imaginary plane of the mating surface of the dielectric housing for firstly engaging with a complementary connector when the male connector is initially engaged therewith;

further comprising an intermediate plate connected between each guiding post and the dielectric housing for reinforcing the guiding posts;

further comprising a pair of conical board locks extending from the spacer plate and axially aligned with the guiding posts in opposite direction with respect to the spacer plate;

wherein each guiding post has a conical head extending beyond an imaginary plane of the mating surface of the dielectric housing for facilitating engagement with the complementary connector;

further comprising at least one rib formed at one surface of the first housing for polarization when the male connector is engaged with the complementary connector.

* * * * *